United States Patent [19]

Howell et al.

[11] Patent Number: 4,754,124

[45] Date of Patent: Jun. 28, 1988

[54] RESISTANCE HEATERS

[75] Inventors: Robert G. Howell, Southport; Malcolm Stevens, Preston, both of England

[73] Assignee: United Kingdom Atomic Energy Authority, London, England

[21] Appl. No.: 20,205

[22] Filed: Mar. 2, 1987

Related U.S. Application Data

[63] Continuation of Ser. No. 635,067, Jul. 27, 1984, abandoned.

[30] Foreign Application Priority Data

Aug. 4, 1983 [GB] United Kingdom ..... 8321028

[51] Int. Cl.[4] ..... H05B 3/06; H01C 3/12

[52] U.S. Cl. ..... 219/523; 219/552; 219/553; 338/141; 338/218; 338/282; 338/294; 338/296; 338/298; 338/302; 338/318; 373/130; 373/134

[58] Field of Search ..... 219/523, 552, 553; 338/141, 218, 282, 294, 296, 298, 302, 318; 373/130, 134

[56] References Cited

U.S. PATENT DOCUMENTS

| | | | |
|---|---|---|---|
| Re. 29,853 | 11/1978 | Perl | 219/270 |
| 785,535 | 3/1905 | Arsem | 373/112 |
| 984,119 | 2/1911 | Wood | 373/112 |
| 2,357,473 | 9/1944 | Jira | 338/292 X |
| 2,371,696 | 3/1945 | Levitt | 338/218 X |
| 2,551,341 | 5/1951 | Scheer et al. | 373/112 |
| 2,677,748 | 5/1954 | Naylor | 338/218 X |
| 2,789,153 | 4/1957 | Mark | 373/112 |
| 2,838,639 | 6/1958 | Planer et al. | 338/218 X |
| 3,289,139 | 11/1966 | Hyde | 338/218 |
| 3,336,431 | 8/1967 | Biddulph | 373/130 |
| 3,411,123 | 11/1968 | Kydd | 338/218 |
| 3,518,351 | 6/1970 | Ohnsorg et al. | 373/134 |
| 3,808,575 | 4/1974 | Brandt et al. | 338/262 |
| 3,851,150 | 11/1974 | Von Holzen | 219/553 |
| 3,859,501 | 1/1975 | Matys | 373/134 X |
| 3,912,908 | 10/1975 | Clark et al. | 219/553 |
| 4,169,128 | 9/1979 | Sinor et al. | 338/218 X |
| 4,327,281 | 4/1982 | Jager et al. | 219/523 |

FOREIGN PATENT DOCUMENTS

| | | | |
|---|---|---|---|
| 659660 | 7/1929 | France | 373/112 |
| 921934 | 5/1947 | France | 338/218 |
| 925897 | 9/1947 | France | 338/217 |
| 993930 | 11/1951 | France | 338/217 |
| 433790 | 8/1935 | United Kingdom | 338/292 |

*Primary Examiner*—E. A. Goldberg
*Assistant Examiner*—Gerald E. Preston
*Attorney, Agent, or Firm*—William R. Hinds

[57] ABSTRACT

A resistance heater for performing heat treatment of the braze-affected area of a metallic sleeve attached by brazing within and to a metallic tube, comprises a metal tube (10) of which a portion (16) is formed with a spiral groove (11) which penetrates the wall thickness of the tube (10) and thereby defines a heating coil. The radial thickness of the convolutions of the coil varies lengthwise of the coil so that, when energized with electrical current, the coil develops a temperature profile which is determined by the variation in radial thickness. The temperature profile may be selected according to the needs of the brazed joint to be heat treated.

7 Claims, 3 Drawing Sheets

RESISTANCE HEATERS

This application is a continuation of application Ser. No. 635,067, filed July 27, 1984, now abandoned.

This invention relates to resistance heaters.

BACKGROUND TO THE INVENTION

In particular, the invention relates to resistance heaters which have an important though not exclusive application to the heat treatment of metallic members which have undergone other operations which can affect metallurgical properties. One example of such a metallic member is a sleeve employed to repair a breach in a tube/tube plate weld of a heat exchanger by being secured in the relevant tube in a position to bridge the breach. The securing may be an explosive weld of one end of the sleeve to the bore of the tube plate, and a braze joint of the other end of the sleeve to the relevant tube. It is necessary to heat treat the sleeve after the making of the joints in order to restore the necessary properties to the braze-affected joints so as to ensure that design life can be expected. The braze is effected at a temperature of the order of 1150° C. for about four minutes and the braze bond is typically about 40 mm in length. Heat treatment however is at a lower temperature of the order of 750° C. but for a longer period, typically one hour. A longer portion than the braze needs to be treated however, typically 150 mm.

The braze heating is performed in one preferred prior art system by an induction probe inserted within the sleeve and accessed from the tube plate bore. However, such probes pose problems of adequate cooling and are expensive. Employment of such probes for heat treatment with its lower temperature and longer period would be wasteful.

FEATURES AND ASPECTS OF THE INVENTION

Heat treatment of the braze-affected area of a metallic sleeve attached by brazing within and to a metallic tube is performed by a resistance heater inserted within the sleeve so as to register with the length of the sleeve over which it is desired to effect heat treatment. The heater used in the process of the invention comprises a generally helical heating coil, characterised in that the radial thickness of the coil convolutions varies lengthwise of the coil whereby the coil develops a temperature profile along its length which is determined by such variation in radial thickness.

In a typical example, to be applied to the heat treatment as aforesaid of a breach-bridging sleeve of a stainless steel over a length of say 115 mm at say 750° C. ±25° C. for say one hour, a typical resistance heater is shown in the accompanying drawings.

DESCRIPTION OF A PREFERRED EMBODIMENT

Figure 1:
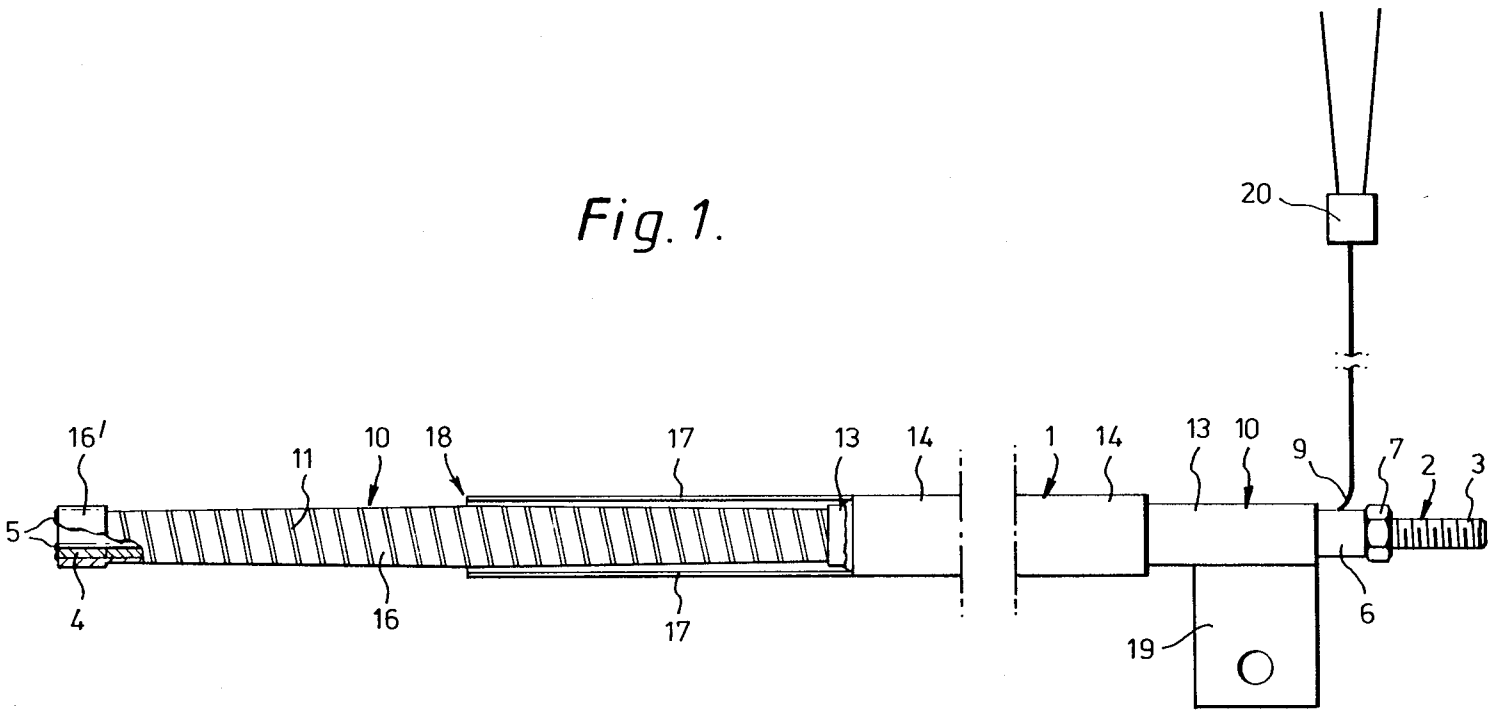
FIG. 1 is an elevation of the heater.

Referring to the drawings an electrical resistance heater 1 comprises a cylindrical electrically conductive core member 2 of a high resistivity Ni/Cr alloy such as KANTHAL or NICHROME (RTM) screw threaded at one end 3 and with a metal bush 4, e.g. also of KANTHAL or NICHROME, welded to the other end at 5. Over the member 2 is fitted a ceramic (e.g. alumina) tube 6 which abuts the bush 4 at one end and is engaged at the other end by a nut 7 on the member 2. There is a longitudinal slot 8 (see FIG. 2) in the tube 6 for reception of a thermocouple 9 which is cemented in position. In a modification, not shown, there is another longitudinal slot disposed in diametrically opposed relationship to the slot 8, enabling another thermocouple to be installed to give a check on the correct operation of the first one.

Over the ceramic tube 6 is fitted a heater tube 10 of electrically conductive metal having a suitable resistivity, e.g. KANTHAL or NICHROME, which has over a portion 16 thereof a helical groove extending through the full thickness of the tube 10 to form a heating coil and typically 1 mm wide on a pitch of 5 mm so that the width of the coil convolutions remains substantially constant over substantially the entire length of the coil. The groove 11, after assembly of the tube 10 with the core member 2 and ceramic tube 6, is filled with electrical insulator packing material, e.g. a suitable cement, so as to space adjacent convulutions of the portion 16 apart. The profile of the tube 10, produced by machining with constant bore, is such that there is a part 16' of maximum diameter thickness situated at the outer end of grooved portion 16 and welded to bush 4, and there is also a cylindrical, ie. non-grooved, portion 13 which is of maximum constant diameter thickness and which is carried in a metallic (e.g. stainless steel) tubular part 14 via a heat conducting sleeve 15 secured by cementing to both parts (see FIG. 2).

The grooved portion 16 of the heater tube 10 projects from the part 14 and is only partially covered by two diametrically opposed part-annular bimetallic strips or wings 17 welded to the main body of part 14 and which terminate short of the outer end of portion 16. The grooved portion 16 of tube 10 diverges to maximum dimaeter thickness, corresponding with that of cylindrical portion 13, at a position 18 intermediate its ends and in register with the outer ends of the strips or wings 17. The grooved portion 16 tapers in both directions from this position 18, in one direction to terminate at its outer end and in the other direction to a step where the portion 14 begins. There is a bracket 19 welded to the end of portion 13 of tube 10 which projects from the non-winged end of tubuler part 14. The thermocouple 9 leads to circuitry 20 for monitoring.

In operation, the cement filling 11 in the grooved portion 16 enables the latter to define a helix of resistance heater material so that the tube 10 functions as a resistance heating element, the resulting heating effect being profiled along the grooved length of portion 16 by virtue of the varying radial thickness thereof as aforesaid. Current is applied at bush 4 to the central core member 2 and passes along the grooved length 16 of tube 10.

The thermocouple 8 functions as the hot junction and is in good heat contact with the bimetallic strips or wings 17 since it is cemented in ceramic tube 6 which is in contact with heater tube 10 which is in contact with tubular part 14 via conducting sleeve 15 and the strips or wings 17 are welded to part 14. The strips or wings 17 are caused, when heat is generated in tube 10, to move outwardly to make firm contact with the breach-bridging sleeve aforesaid, thereby enabling the temperature of that sleeve to be constantly monitored by the thermocouple 8 so that the amount of heat generated by the tube 10 can be adjusted by varying the electric current supplied thereto so as to ensure that optimum conditions for the required heat treatment are provided.

The heater may have two bimetallic strips 17 at diametrically opposed positions with associated thermocouples so that temperatures are measured across a diameter of the tube, this being capable of being used to check uniformity of temperature or provide a check of correct operating of the hot junctions, a large difference of temperature measurement indicating either a fualty hot junction or a poor contact. If desired, the bi-metals can be fitted into slots cut into the heater.

Figure 3:
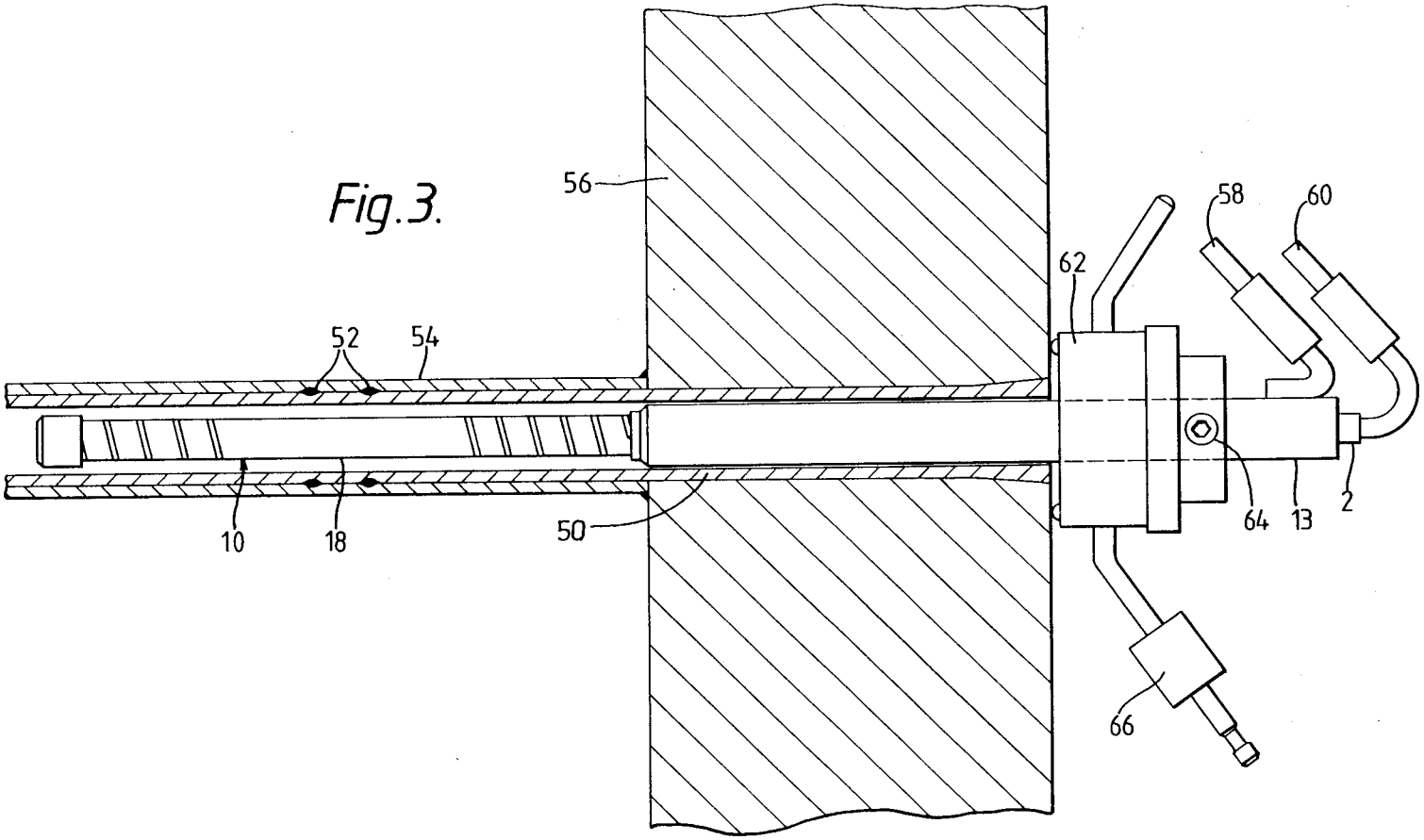
FIG. 3 is a diagrammatic side view illustrating the use of a resistance heater according to the invention for the heat treatment of a breach-bridging sleeve brazed joint.

FIG. 3 illustrates use of the resistance heater for the heat treatment of the braze 52 between a breach-bridging sleeve 50 and a heat exchange tube 54 welded to tube plate 56. The heater 10 is so arranged that the grooved portion 16 thereof has its largest thickness zone 18 disposed in registry with the braze filaments 52. Because the radial thickness of the grooved portion decreases towards each end thereof, it will be understood that the heater 10 develops its maximum temperatures adjacent the ends of portion 16. In this way, end effect cooling can be compensated for so as to achieve a substantially uniform temperature in the region of the braze filaments.

Figure 2:
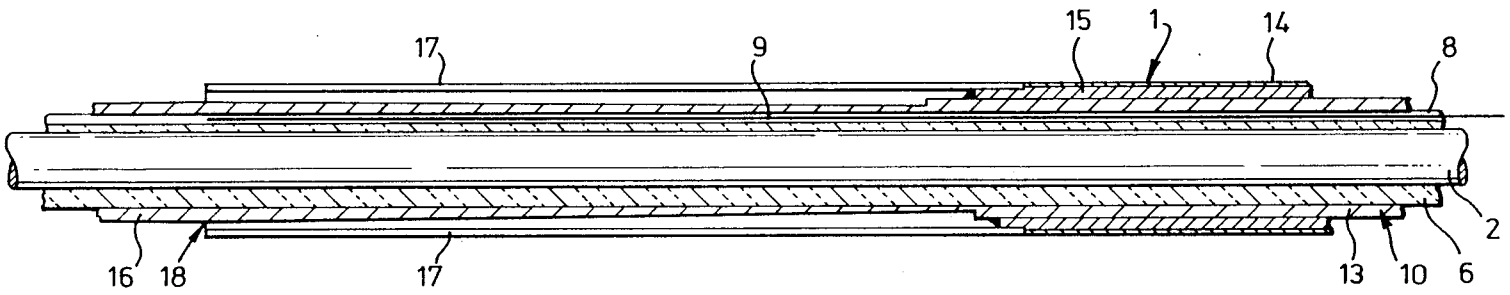
FIG. 2 is an enlarged view in section of part of FIG. 1.

The heater 10 shown in FIG. 3 differs from that shown in FIGS. 1 and 2. For example, the bimetallic wings or strips 17 and associated thermocouples can be omitted since temperature monitoring may be effected by other means. Power is supplied to the heater via connectors 58, 60 connected respectively to the core 2 and portion 13 of the tube 10. The heater is mounted slidably in a carrier 62 with some form of locking device 64, e.g. a locking screw, being provided to fix the same at a desired position along the heater. A gas connector 66 allows the carrier 62 to be connected to a source of inert gas so that a suitable non-oxidizing atmosphere can be created within the sleeve 50 during heat treatment.

We claim:

1. An electrical resistance heater comprising: an electrically insulating sleeve; a central conductor extending through said sleeve; a metal tube which receives said insulating sleeve; a helical groove formed in a portion of said tube such that the groove penetrates the wall thickness of the tube and thereby creates a series of convolutions which form a heating coil; means for electrically connecting the central conductor to one end of the tube whereby electrical current can be supplied along the length of said central conductor and returned via said one end of the tube, said coil and the other end of the tube; and a packing of electrically insulating material received within said groove to space apart the coil convolutions; said metal tube being of substantially uniform internal diameter and of variable outside diameter such that the radial thickness of the coil convolutions increases from one end of the coil toward a point intermeditae its ends and decreases from said point towards the opposite end of the coil, said coil convolutions being of substantially the same width whereby the electrical resistance of the coil increases and decreases along its length according to the decrease or increase in radial thickness of the coil convolutions.

2. A heater as claimed in claim 1 in which the ungrooved portions of the tube adjacent each coil end are of greater radial thickness than the contiguous coil convolutions.

3. An electrical resistance heater probe comprising a tube providing a generally helical heating coil, an electrical conductor extending along and within the tube and electrically connected to one end of the tube so that electric current can flow in opposite directions along the tube and the conductor, in which the coil has convolutions of solid cross-section and the radial thickness of the coil convolutions varies lengthwise of the coil whereby the coil develops a temperature profile along its length which is dependent on such variation in radial thickness.

4. A heater as claimed in claim 3 in which the axial width of the coil convolutions remains substantially constant over substantially the entire axial length of the convolutions whereby said temperature profile along the axial length of the convolutions is determined solely by the variation in radial thickness of the coil convolutions.

5. A heater as claimed in claim 3 in which the coil convolutions disposed in a central region of the coil are of greater radial thickness than those adjacent the ends of the coil whereby the coil develops higher temperatures adjacent its ends.

6. A heater as claimed in claim 3 in which the coil comprises a tube formed with a helical groove which penetrates the full thickness of the tube so as to define said convolutions and which groove is filled with an electrically insulating packing material to maintain said convolutions spaced apart from one another.

7. A heater as claimed in claim 6 in which the helical groove extends over part only of the length of the tube and in which the ungrooved portions of the tube have a radial thickness which is at least as great as that of the coil convolution or convolutions with the largest radial thickness, there being an ungrooved tube portion at each end of the grooved portion of the tube.

* * * * *